US005826529A

United States Patent [19]

Ely

[11] Patent Number: 5,826,529

[45] Date of Patent: Oct. 27, 1998

[54] STABILIZING HULL FOR WATERCRAFT

[76] Inventor: James Edward Ely, 63 Ray Rd., Moonville Community, Piedmont, S.C. 29673-8119

[21] Appl. No.: 858,448

[22] Filed: May 19, 1997

Related U.S. Application Data

[60] Provisional application No. 60/020,019 Jun. 19, 1996.

[51] Int. Cl.[6] ..... B63B 1/00

[52] U.S. Cl. ..... 114/61

[58] Field of Search ..... 114/357, 355, 114/356, 61, 123, 283, 264, 292, 265, 266

[56] References Cited

U.S. PATENT DOCUMENTS

| | | | |
|---|---|---|---|
| 522,348 | 7/1894 | Martini | 114/61 |
| 921,462 | 5/1909 | Ritson | 441/45 |
| 1,723,213 | 8/1929 | Smith | 114/61 |
| 3,785,317 | 1/1974 | Currey | 114/61 |
| 4,762,078 | 8/1988 | Palmer, Jr. | 114/39.1 |
| 5,056,448 | 10/1991 | Miller, Sr. | 114/61 |
| 5,377,608 | 1/1995 | Harper, Jr. | 114/61 |
| 5,595,132 | 1/1997 | Bystedt et al. | 114/61 |

FOREIGN PATENT DOCUMENTS

| | | |
|---|---|---|
| 870916 | 5/1971 | Canada . |
| 1129117 | 12/1984 | U.S.S.R. . |

*Primary Examiner*—Stephen Avila
*Attorney, Agent, or Firm*—Richard C. Litman

[57] ABSTRACT

The invention relates to a stabilizing hull for watercraft. The hull comprises a series of sealed, hollow, aluminum tubes. The entire structure is held together with a lightweight aluminum frame. The pontoons are preferably six-inch diameter, aluminum pipes with a circular cross section. However, different materials, different size pipes, or pipes with different cross sections may also be used. The pontoons are arranged in a side by side parallel configuration, with the aluminum frame connected to the top of each pontoon. Each of the pontoons is sealed at both ends and is turned up at one end to form the bow of the hull. The frame supports a planar sheet that acts as the floor of the boat. A load leveler may also be attached to an extension connected to the rear of the frame to improve maneuverability through the water and to increase the load support of the hull. A further embodiment of the hull includes two additional pontoon units on each side of the hull. Each of the pontoon units has a top pontoon and a bottom pontoon. The units are attached to each side of the frame using three metal brackets. The bottom pontoons of each unit are positioned side by side with the pontoons under the frame, and are also turned up in the front, while the top pontoons of each unit extend from the point the bottom pontoon is turned up, to the rear of the bottom pontoon. The number of pontoons, size of the pontoons, and the spacing between the pontoons, can be changed for different weight capacity needs.

19 Claims, 9 Drawing Sheets

STABILIZING HULL FOR WATERCRAFT

CROSS-REFERENCE TO RELATED APPLICATION

This application claims the benefit of U.S. Provisional Patent Application Ser. No. 60/020,019, filed Jun. 19, 1996.

BACKGROUND OF THE INVENTION

1. Field of the Invention

The present invention relates to a stabilizing hull for watercraft.

2. Description of Prior Art

Many different designs for watercraft are known. Flat bottom boats ride high in the water, but are very unstable, and thus are subject to overturning in moderate to heavy seas or waves. V-hull or tri-hull boats ride deep in the water, and are also subject to severe rolling in high seas or waves. Conventional pontoon boats are more stable than the above designs, but ride much deeper in the water than the present invention, and are subject to porpoising (front end submergence).

U.S. Pat. No. 921,462, issued on May 11, 1909 to Charles Ritson, discloses a life raft having a pontoon-like main hull with two outrigger pontoons. Ritson does not suggest the stabilizing hull configuration including a frame according to the present invention.

U.S. Pat. No. 1,723,213, issued on Aug. 6, 1929 to Augustus Smith, discloses a raft made up of a plurality of pontoons. Smith does not suggest the stabilizing hull configuration according to the present invention.

U.S. Pat. No. 3,785,317, issued on Jan. 15, 1974 to Jack L. Currey, discloses a boat constructed of a number of pontoons, the pontoons being turned up at their ends. Currey does not suggest the stabilizing hull configuration according to the present invention.

U.S. Pat. No. 4,762,078, issued on Aug. 9, 1988 to John M. Palmer, Jr., discloses an inflatable vessel having a number of inflatable pontoons. Palmer, Jr. does not suggest the stabilizing hull configuration according to the present invention.

U.S. Pat. No. 5,056,448, issued on Oct. 15, 1991 to Terry L. Miller, Sr., discloses a boat made of PVC pipe and having two pontoons turned up at their ends. Miller, Sr. does not suggest the stabilizing hull configuration according to the present invention.

Canadian Pat. No. 870,916, published on May 18, 1971, discloses a motorized float having a number of pontoons to provide buoyancy. The Canadian '916 patent does not suggest the stabilizing hull configuration according to the present invention.

Soviet Union Pat. No. 1,129,117, published on Dec. 15, 1984, discloses a multi-hull sailing vessel wherein the hulls are in the shape of pontoons. The Soviet '117 patent does not suggest the stabilizing hull configuration according to the present invention.

None of the above inventions and patents, taken either singly or in combination, is seen to describe the instant invention as claimed.

SUMMARY OF THE INVENTION

The present invention is a stabilizing hull for a boat. The hull comprises a plurality of pontoons constructed of aluminum pipes, and connected to each other with a lightweight aluminum frame. The pontoons are preferably six-inch diameter, aluminum pipes with a circular cross section. However, different materials, different size pipes, or pipes with different cross sections, such as trapezoidal, triangular, square with a rounded bottom, five-sided, etc., may be used. The pontoons are arranged in a side by side configuration, with the aluminum frame connected to the top of each pontoon by three brackets attached to the frame by nuts and bolts. Each pontoon is sealed at both ends and is turned up at one end to form the front of the hull. The frame supports a planar, preferably wood, sheet that acts as the floor of the boat. The sheet is covered in an indoor-outdoor carpet for comfort.

An additional embodiment of the invention includes a load leveler attached to the rear of the frame to improve maneuverability through the water and to increase the load support of the hull. The load leveler is connected by brackets attached to an extension that is physically secured to the rear of the frame.

A further embodiment of the invention includes an additional pontoon unit on each side of the hull. Each of the additional pontoon units comprises a top pontoon and a bottom pontoon. The units are each attached to a side of the frame using three metal brackets attached to the frame with nuts and bolts. The bottom pontoon of each unit is positioned side by side with the pontoons under the frame, and are also turned up in the front. The top pontoon of each unit extends from the point the bottom pontoon is turned up, to the rear of the bottom pontoon. The top and bottom pontoon of each unit are welded together using three brackets each having an H-shaped cross section. The pontoons of each unit extend rearwardly approximately two feet beyond the rear ends of the pontoons under the frame, to provide additional stability for the rear of the hull. The number of pontoons, size of the pontoons, and the spacing between the pontoons (preferably one inch), can be changed for different weight capacity needs.

Accordingly, it is a principal object of the invention to provide a hull for a boat that is resistant to wave force.

It is another object of the invention to provide a boat hull that rides high in the water.

It is a further object of the invention to provide a hull that is light in weight.

Still another object of the invention is to provide a boat hull that is inexpensive and easy to manufacture.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
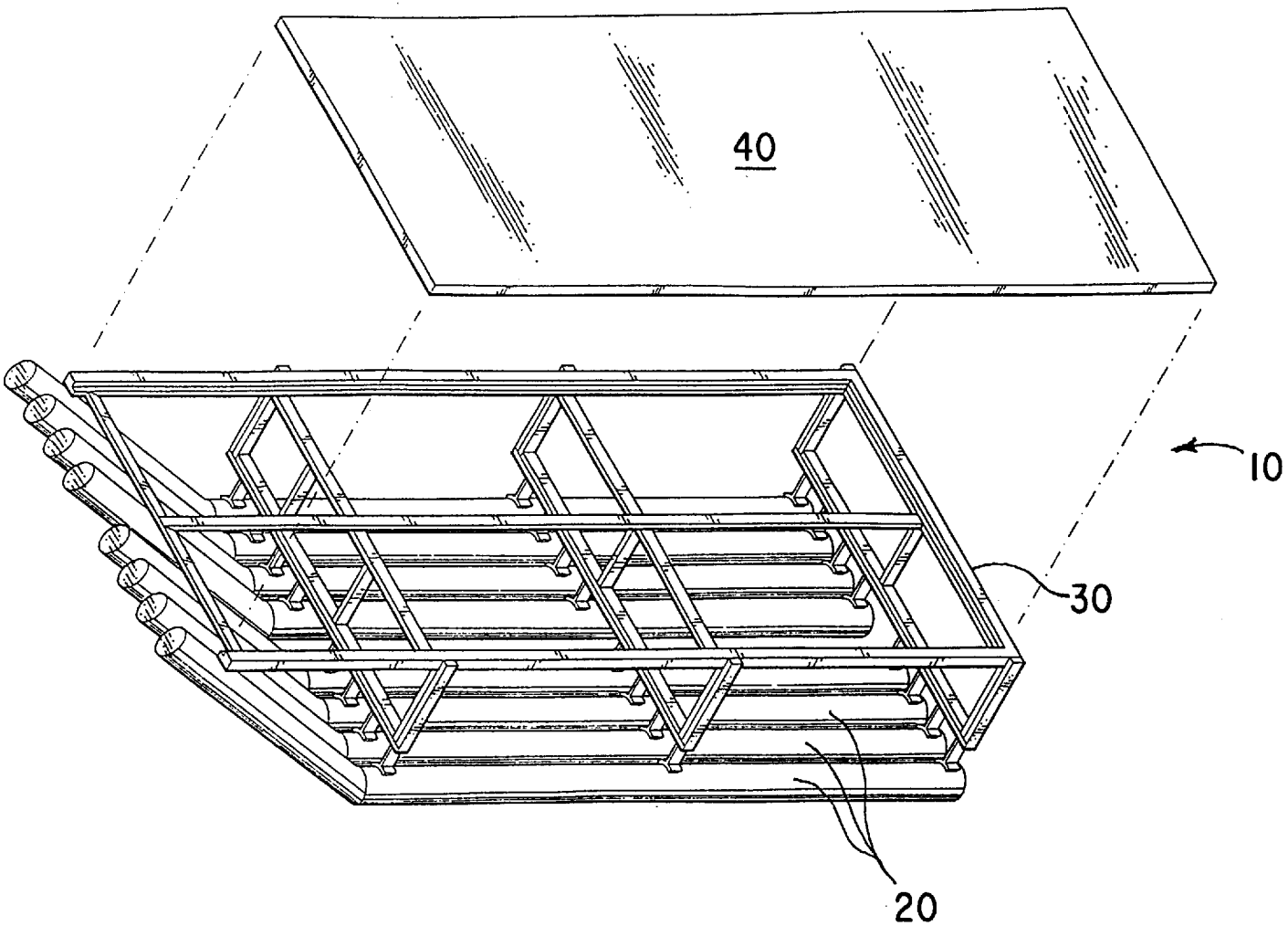
FIG. 1 is a perspective view of a first embodiment of the boat hull of the present invention.

In FIG. 1, boat hull 10 is shown to include a plurality of pontoons 20 connected to a frame 30, that supports a platform 40. While the number of pontoons shown in FIG. 1 is eight, any number of pontoons can be used depending on the size of each pontoon, and the weight capacity desired for the hull. Preferably, the pontoons 20 have circular cross-sections six inches in diameter, and the pontoons 20 and the frame 30 are made from aluminum. However, different materials, different size pipes, or pipes with different cross sections, such as trapezoidal, triangular, square with a rounded bottom, five-sided, etc., may be used.

Figure 2:
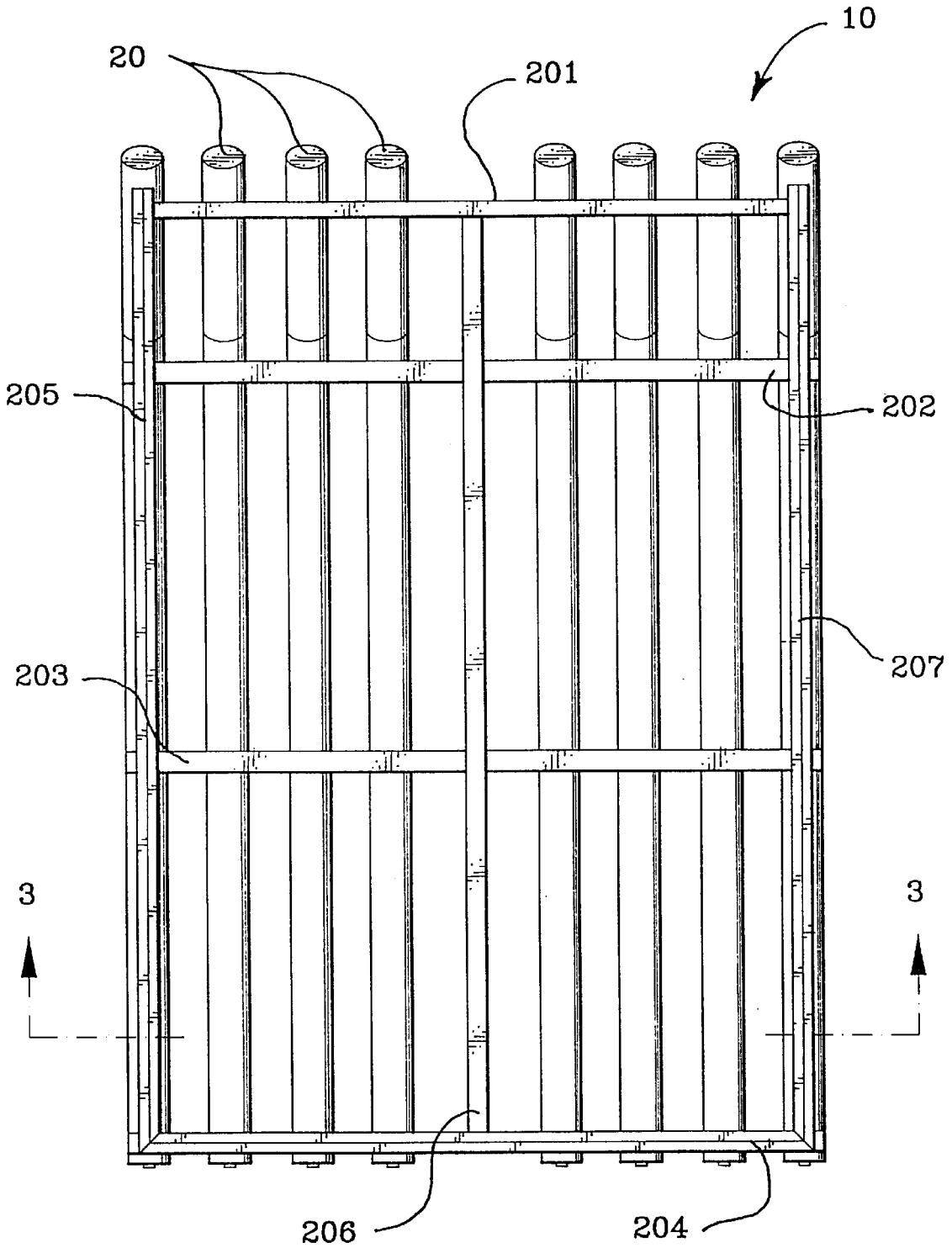
FIG. 2 is a top view of the boat hull of FIG. 1.

As best seen in FIG. 2, the frame 30 is made up of two side longitudinal struts 205, 207, a central longitudinal strut 206, a front lateral strut 201, a rear lateral strut assembly 204, and two central lateral strut assemblies 202 and 203.

Figure 3:
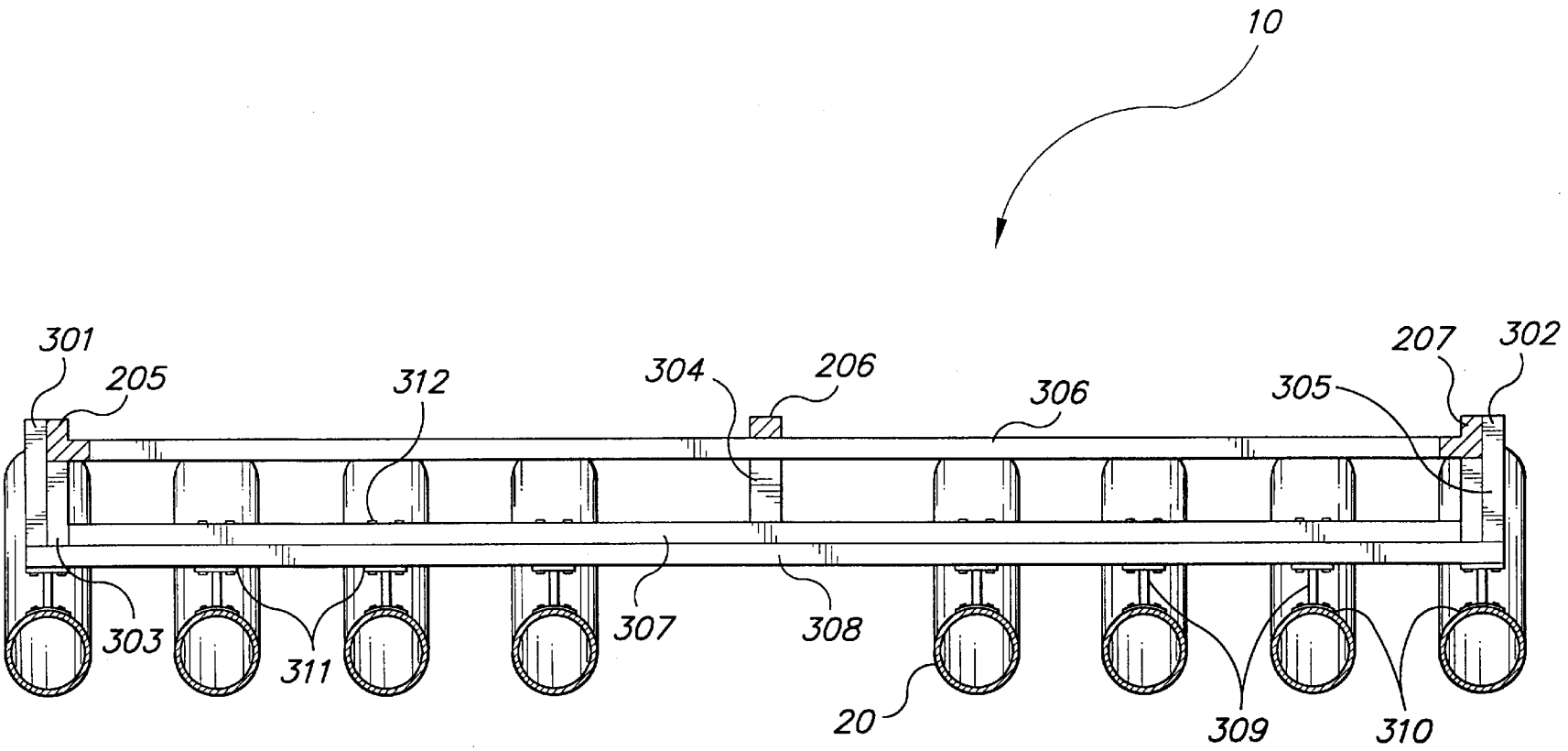
FIG. 3 is a rear view of the boat hull of FIG. 1 taken through cross section 3—3 in FIG. 2.

FIG. 3 shows a rear view of the boat hull of FIG. 2 through cross section 3—3. While FIG. 3 shows the details of lateral strut assembly 203, it should be noted that lateral strut assemblies 202 and 204 have similar constructions. Each lateral strut assembly has two lateral struts 306 and 307, three vertical struts 303–305, a reinforcing bottom lateral strut 308, and two reinforcing side vertical struts 301 and 302. Note that while FIG. 3 shows lateral strut assembly 203 having three vertical struts, more than three vertical struts may be used, as in lateral strut assembly 202 which has four vertical struts, as best seen in FIG. 1. Each pontoon 20, has three brackets 309 attached thereto by a weld 310 that extends around the curved part of the bracket contacting the pontoon. The brackets 309 are attached to the lateral strut assemblies by two bolts 311 and two mating nuts 312, the bolts extending through holes in the brackets, and holes in both lateral strut 307 and reinforcing bottom lateral strut 308. It can also be seen in FIG. 3 that longitudinal struts 205 and 207 have L-shaped cross sections. The L-shape allows platform 40 to rest in the grooves of struts 205 and 207, and on top of strut 206, thus providing lateral stability of the platform 40. Additionally, the rear lateral strut assembly 204 supports a rear lateral strut also having an L-shaped cross section, best seen in FIG. 1, to provide longitudinal stability to platform 40.

Figure 4:
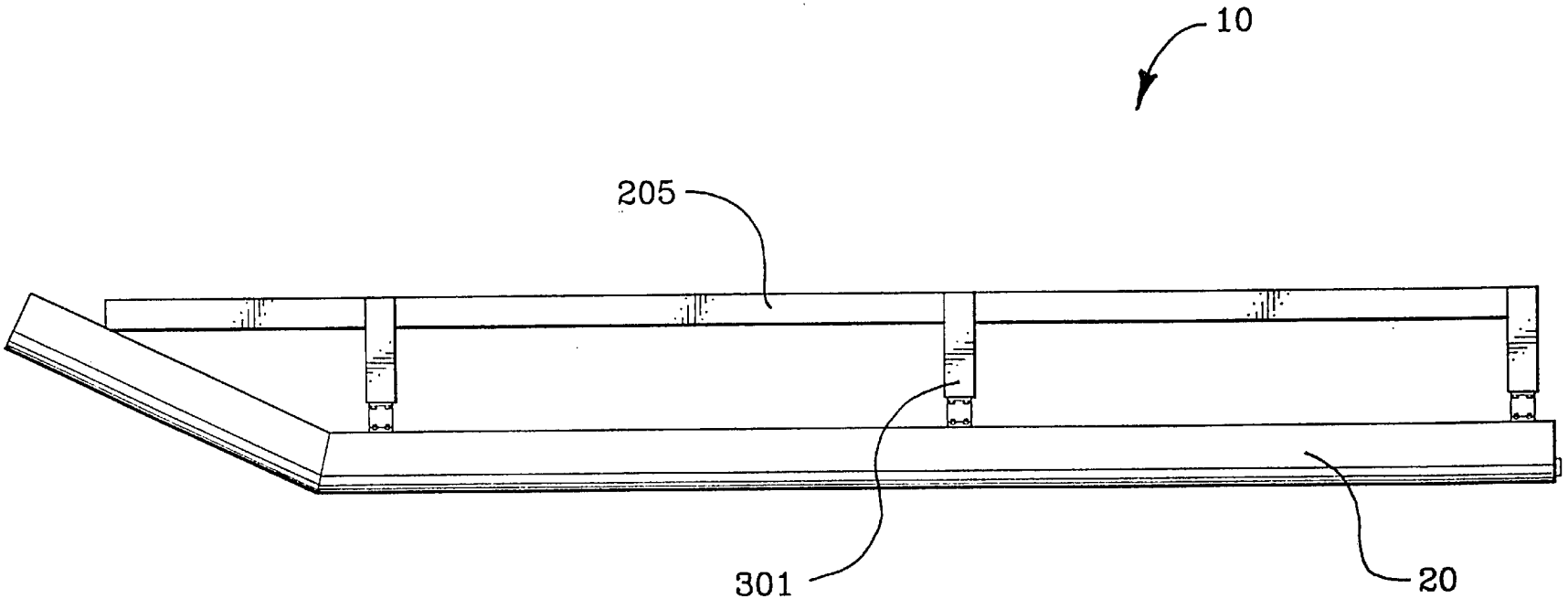
FIG. 4 is a side elevational view of the boat hull of FIG. 1.

The turned up front end portion of pontoons 20 is best shown in FIG. 4, which shows a left side elevational view of the hull of FIGS. 1 and 2. It should be noted that longitudinal strut 205 and longitudinal strut 207, not shown in FIG. 4, both extend to the turned up front end portion of the pontoons 20, and are welded to opposite ends of front lateral strut 201, as best seen in FIG. 2. Front lateral strut 201 does not have an L-shaped cross section as do the two longitudinal and rear lateral struts. Front strut 201 has a flat cross section with a thickness equal to the thickness of middle longitudinal strut 206, which allows platform 40 to rest flatly on top of struts 201 and 206, while the edges of platform 40 are held in place by the grooves in the rear lateral strut and struts 205 and 207. The front edge of the platform 40 is held in place by the groove formed between front lateral strut 201 and the turned up front end portions of the pontoons 20.

Figure 5:
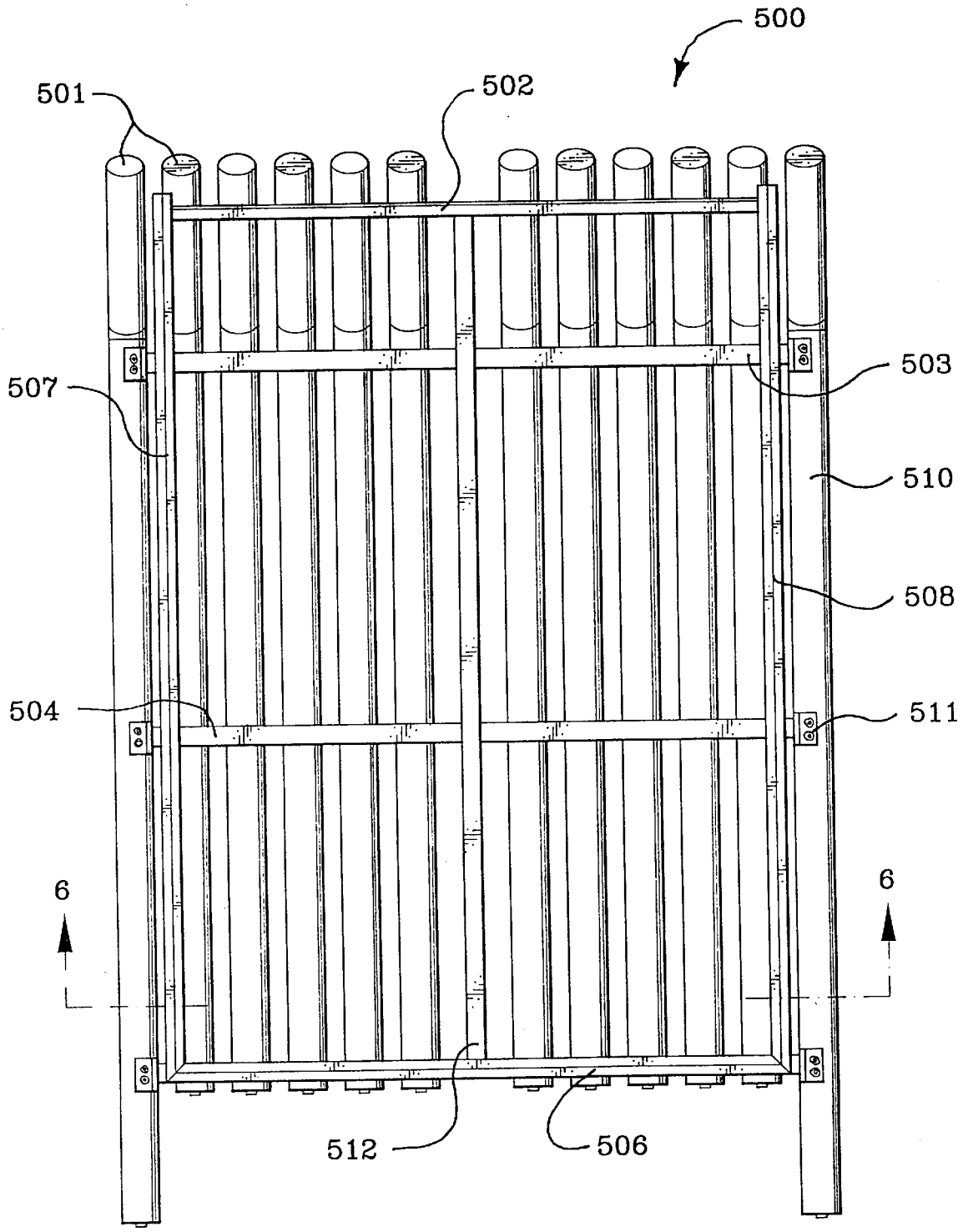
FIG. 5 is a top view of a second embodiment of the boat hull of the present invention.

FIG. 5 is a top view of a second embodiment of the boat hull 500 of the present invention. The frame of hull 500 is substantially the same as frame 30 of boat hull 10, and includes two side longitudinal struts 507, 508, a central longitudinal strut 512, a front lateral strut 502, a rear lateral strut assembly 506, and two central lateral strut assemblies 503 and 504. The pontoons 501 under the frame of hull 500 are more evenly spaced across the lateral dimension of the frame, unlike pontoons 20 of hull 10 which include a wider gap between the middle two pontoons of the hull (see FIG. 2). The gap in hull 10, provides lateral stability by increasing the buoyancy on the sides of the hull 10. Hull 500 is provided stability in this manner by two additional pontoon units mounted on each side of the hull. The additional pontoon units are comprised of a bottom pontoon 509 and a top pontoon 510. Three brackets 511 are welded to the top of top pontoon 510.

Figure 6:
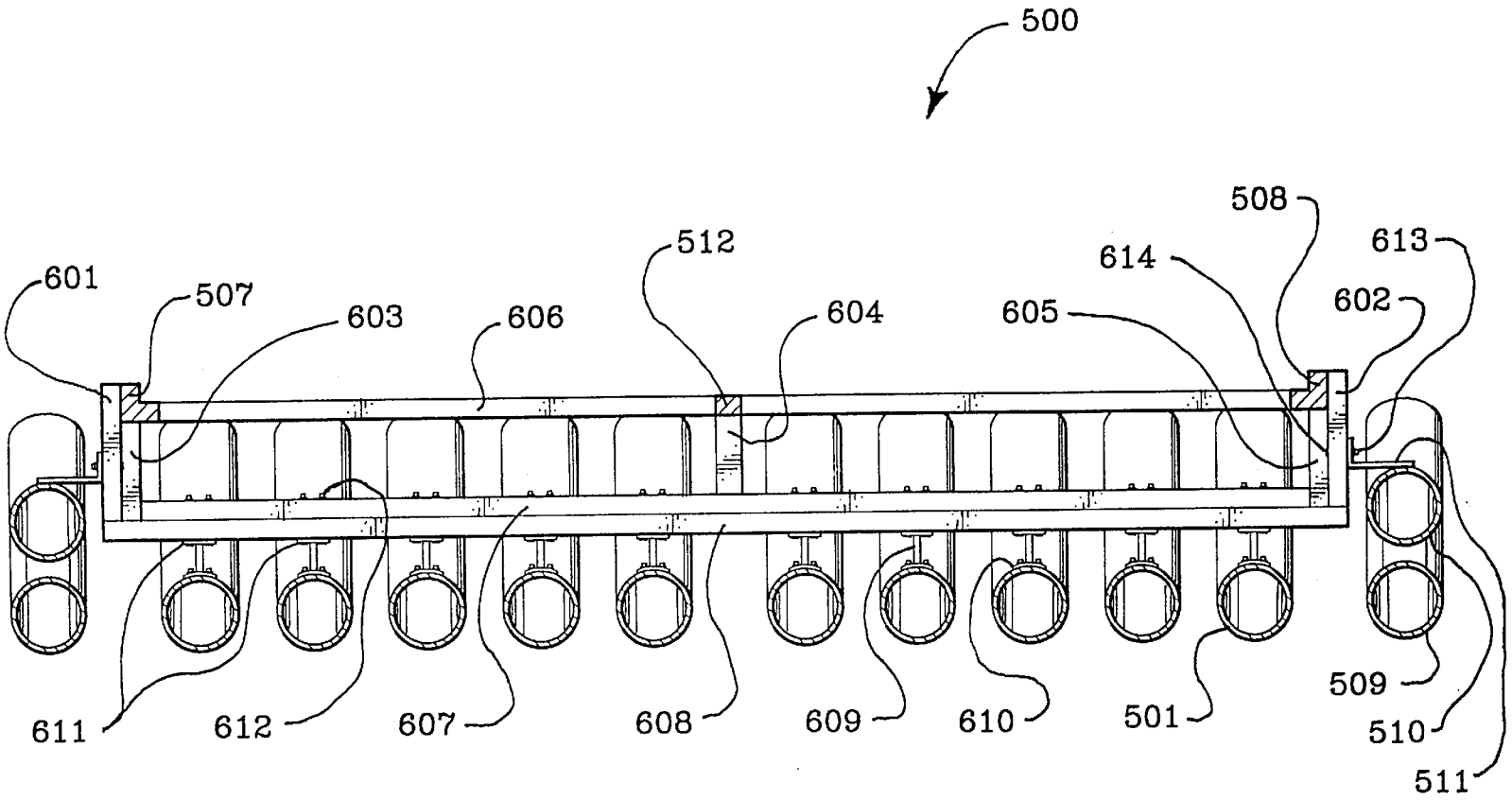
FIG. 6 is a rear view of the boat hull of FIG. 5 taken through cross section 6—6.

FIG. 6 shows a rear view of the boat hull of FIG. 5 through cross section 6—6. Lateral strut assembly 504 is substantially the same as the lateral strut assembly 203 in FIG. 3, and it should also be noted that lateral strut assemblies 503 and 506 have similar constructions. Each lateral strut assembly has two lateral struts 606 and 607, three vertical struts 603–605, a reinforcing bottom lateral strut 608, and two reinforcing side vertical struts 601 and 602. Each pontoon 501, has three brackets 609 attached thereto by a weld 610 that extends around the curved part of the bracket contacting the pontoon. The brackets 609 are attached to the lateral strut assemblies by two bolts 611 and two mating nuts 612, the bolts extending through holes in the brackets, and holes in both lateral strut 607, and reinforcing bottom lateral strut 608. It can also be seen in FIG. 6, that longitudinal struts 507 and 508 have L-shaped cross sections. The L-shape allows platform 40 to rest in the grooves of struts 507 and 508, and on top of strut 512, thus providing lateral stability of the platform 40. Additionally, the rear lateral strut assembly 506 supports a rear lateral strut also having an L-shaped cross section, best seen in FIG. 1, to provide longitudinal stability to platform 40. The additional pontoon units are attached to the frame by brackets 511 which are connected to the lateral strut assemblies 503, 504, and 506 by bolt 613 and nut 614. Bolt 613 extends through a hole in the bracket 511 and holes in vertical struts 603, 605, and reinforcing vertical struts 601 and 602.

Figure 7:
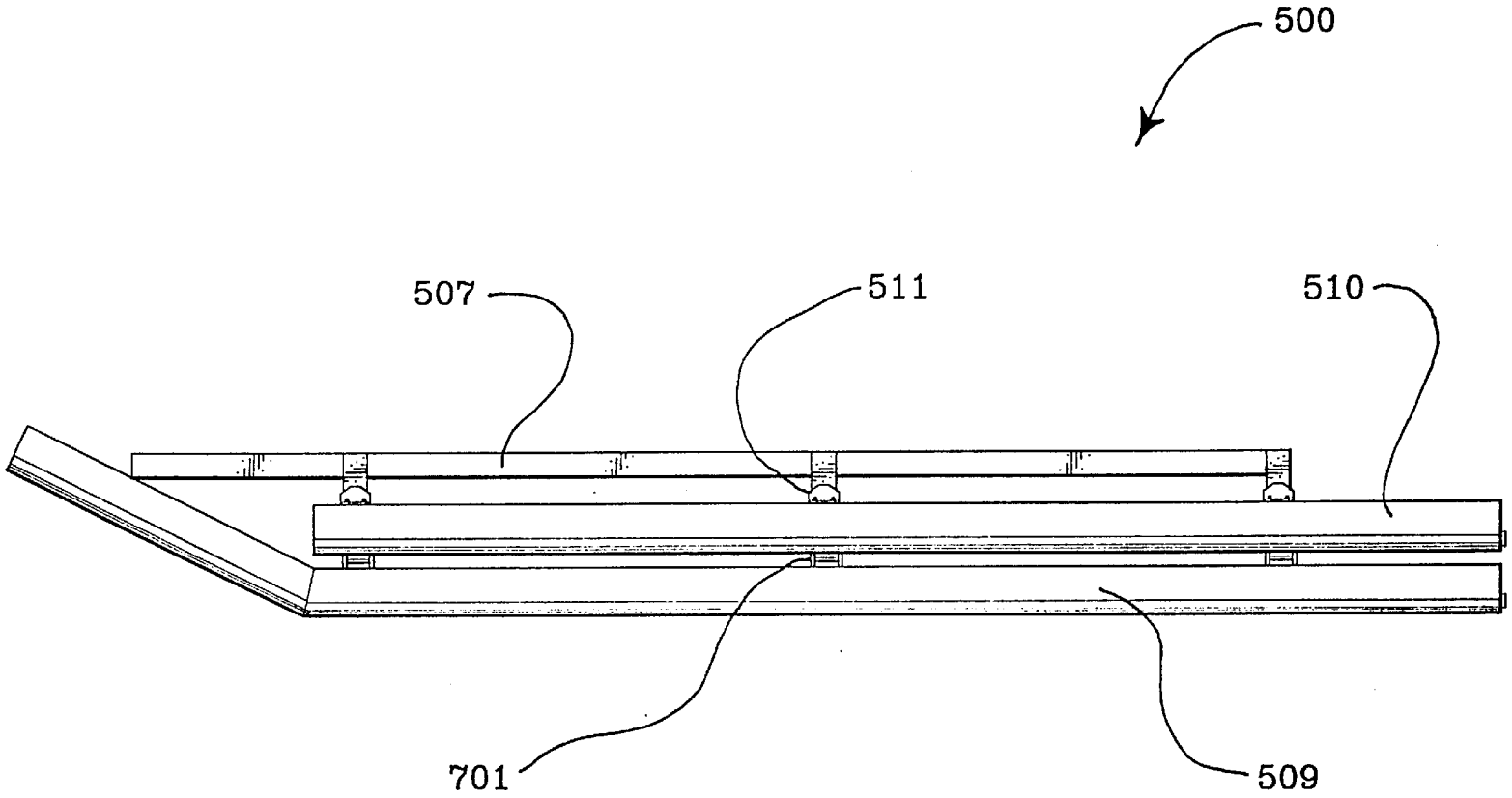
FIG. 7 is a side elevational view of the boat hull of FIG. 5.
Figure 8A:
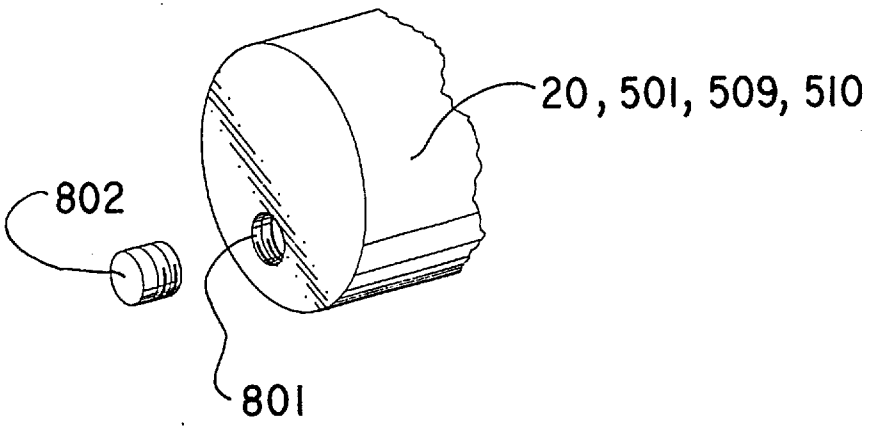
FIG. 8A is a rear perspective view of a pontoon of the present invention.
Figure 8B:
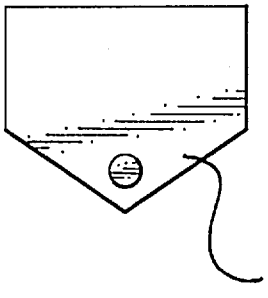
FIGS. 8B, 8C, 8D and 8E are each a rear elevational view of a pontoon of the present invention, each showing a different cross sectional shape and the drain and plug assembly.
Figure 8C:
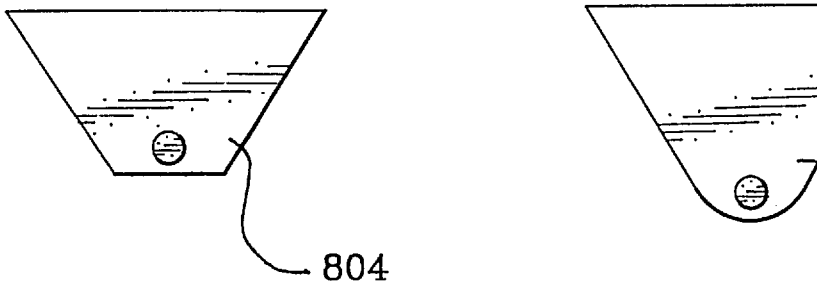
Figure 8D:
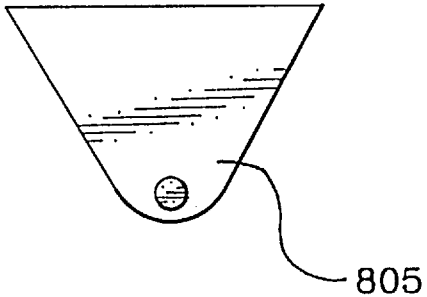
Figure 8E:
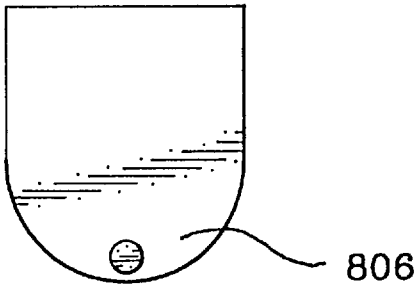

The turned up front end portion of pontoons 501 is best shown in FIG. 7 which shows a left side elevational view of the hull of FIGS. 5 and 6. It should be noted that longitudinal strut 507 and longitudinal strut 508, not shown in FIG. 7, both extend to the turned up front end portion of the pontoons 501, and are welded to opposite ends of front lateral strut 502, as best seen in FIG. 5. Front lateral strut 502 does not have an L-shaped cross section as do the two longitudinal and rear lateral struts. Front strut 502 has a flat cross section with a thickness equal to the thickness of middle longitudinal strut 512, which allows platform 40 to rest flatly on top of struts 502 and 512, while the edges of platform 40 are held in place by the grooves in the rear lateral strut and struts 507 and 508. The front edge of the platform 40 is held in place by the groove formed between front lateral strut 502 and the turned up front end portions of the pontoons 501. Pontoons 509 and 510 of the additional pontoon units are held together by brackets 701 each of which has an H-shaped cross section and are welded to pontoons 509 and 510.

FIG. 8 shows a rear view of pontoons 20, 501, 509 and 510, and includes a detailed view of the drain hole 801 and drain plug 802 which each pontoon of the hull has to remove any water that may collect inside the pontoons. Further, FIG. 8 shows alternate cross sectional shapes of the pontoons including five sided 803, trapezoidal 804, triangular 805, and four sided with a convex bottom side 806.

Figure 9:
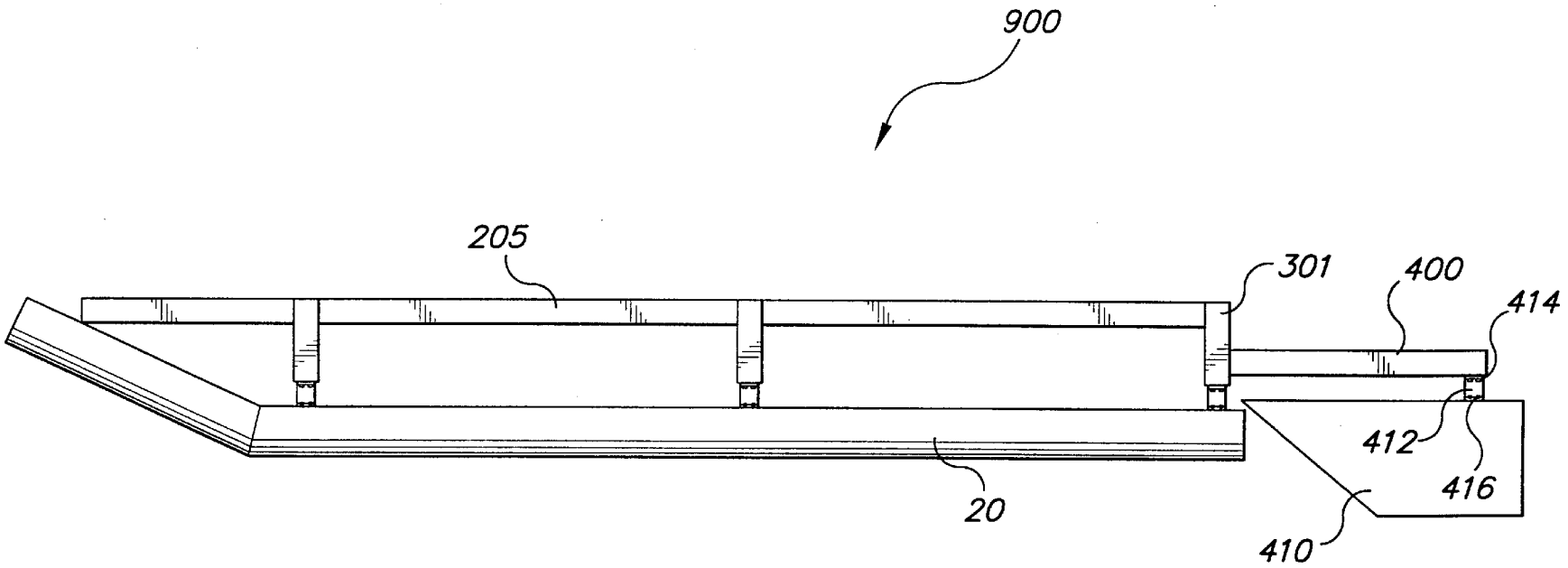
FIG. 9 is a side elevational view of the boat hull of FIG. 1 with the inclusion of a load leveler of the present invention.

FIG. 9 shows a left side elevational view of a third embodiment of the boat hull 900 of the invention. The boat hull 900 is the same as hull 10 shown in FIGS. 1–4 with the addition of a frame extension 400 which supports a load leveler 410. The inclusion of the load leveler 410 changes the performance of the hull 10. For example, the load leveler 410 can enable hull 10 to be readily rotated 360 degrees and can greatly increase the speed of hull 10. The frame extension 400 has two longitudinal struts connected to rear lateral strut assembly 204 and connected to each other by a lateral strut (not shown). Each longitudinal strut of extension 400 has at least one bracket 412 attached thereto by two bolts and two mating nuts (not shown). The load leveler 410 is attached to each bracket 412 on each longitudinal strut of extension 400 by two bolts 416 and two mating nuts (not shown). Alternatively, the load leveler 410 may be attached to frame extension 400 by means which enable it to be raised or lowered to change the way the hull sits and travels on the water. The load leveler 410 is a closed container, preferably made from aluminum, with substantially flat sides. The load leveler 410 includes a top wall, a rear wall, a bottom wall, a front wall, and two side walls. A length of the top wall is longer than a length of the bottom wall, and the top wall is connected to the bottom wall by the front wall which forms an acute angle with the top wall. The rear wall is preferably approximately ten inches high; however, other dimensions may be employed. The load leveler 410 may also comprise a plurality of closed containers corresponding to the number of pontoons 20 employed, wherein each closed container is directly attached to a pontoon 20.

It is to be understood that the present invention is not limited to the embodiments described above, but encompasses any and all embodiments within the scope of the following claims.

I claim:

1. A stabilizing hull for watercraft comprising:

a predetermined number of parallel pontoons;

a frame comprising two side longitudinal struts having L-shaped cross sections, a front lateral strut, a rear lateral strut assembly, at least two central lateral strut assemblies, and a central longitudinal strut; and each said rear and at least two central lateral strut assemblies comprising a top lateral strut, a bottom lateral strut, a reinforcing bottom lateral strut, at least three vertical struts, and two reinforcing vertical struts.

2. The stabilizing hull according to claim 1 wherein each pontoon has a drain hole and a drain plug at a first end thereof.

3. The stabilizing hull according to claim 1 wherein the pontoons and the frame are formed from aluminum.

4. The stabilizing hull according to claim 1 wherein each pontoon has at least three brackets welded thereto, said brackets being bolted to said rear lateral strut assembly and said at least two central lateral strut assemblies through said bottom lateral struts and said reinforcing bottom lateral struts.

5. The stabilizing hull according to claim 1 including a planar sheet supported by said two side longitudinal struts, said front lateral strut, said rear lateral strut assembly, said at least two central lateral strut assemblies, and said central longitudinal strut.

6. The stabilizing hull according to claim 1 wherein the stabilizing hull has a first end and wherein each pontoon has two ends, a first of said ends of each pontoon being upturned to form a bow at said first end of said hull.

7. The stabilizing hull according to claim 6 including two additional pontoon units on each side of said hull.

8. The stabilizing hull according to claim 7 wherein each pontoon unit is comprised of a top pontoon and a bottom pontoon.

9. The stabilizing hull according to claim 8 wherein each bottom pontoon has first and second ends, said first end of each bottom pontoon being upturned at said first end of said hull.

10. The stabilizing hull according to claim 9 wherein each top pontoon is mounted directly above a bottom pontoon and extends from a point where the bottom pontoon is upturned to said second end of the bottom pontoon.

11. The stabilizing hull according to claim 10 wherein each additional pontoon unit has at least two brackets welded to a top of a top pontoon, each said bracket being bolted to one of said rear lateral strut assembly and said at least two central lateral strut assemblies through one of said vertical struts and one of said reinforcing vertical struts.

12. The stabilizing hull according to claim 1 including a frame extension, a load leveler, means connecting said frame extension to said load leveler, and means connecting said frame extension to said rear lateral strut assembly, wherein said load leveler is a closed container including a top wall, a rear wall, a bottom wall, a front wall, and two side walls, and a length of said top wall is longer than a length of said bottom wall.

13. The stabilizing hull according to claim 12 wherein said frame extension comprises two longitudinal struts and means which enable said load leveler to be raised or lowered to change the way the hull sits and travels on water.

14. The stabilizing hull according to claim 1 including a plurality of load levelers corresponding to said plurality of pontoons, wherein each load leveler is directly connected to a pontoon and is a closed container including a top wall, a rear wall, a bottom wall, a front wall, two side walls, and a length of said top wall is longer than a length of said bottom wall.

15. The stabilizing hull according to claim 1 wherein a lateral cross section of each pontoon is annular.

16. The stabilizing hull according to claim 1 wherein a lateral cross section of each pontoon is five sided.

17. The stabilizing hull according to claim 1 wherein a lateral cross section of each pontoon is trapezoidal.

18. The stabilizing hull according to claim 1 wherein a lateral cross section of each pontoon is triangular.

19. The stabilizing hull according to claim 1 wherein a lateral cross section of each pontoon is four sided with a bottom side thereof being convex.

* * * * *